United States Patent [19]

Weaver

[11] Patent Number: 4,801,908

[45] Date of Patent: Jan. 31, 1989

[54] SMALL RELAY FOR AUTOMATED ASSEMBLY

[75] Inventor: Robert F. Weaver, Brownsburg, Ind.

[73] Assignee: Emhart Industries, Inc., Indianapolis, Ind.

[21] Appl. No.: 100,728

[22] Filed: Sep. 25, 1987

[51] Int. Cl.[4] ..... H01H 51/22

[52] U.S. Cl. ..... 335/80; 335/83; 335/86

[58] Field of Search ..... 335/78, 79, 80, 81, 335/82, 83, 84, 128, 202, 86, 127

[56] References Cited

U.S. PATENT DOCUMENTS 4,112,400 9/1978 Jaidinger et al. ..... 335/128

4,320,369 3/1982 Bukala ..... 335/128

*Primary Examiner*—E. A. Goldberg

*Assistant Examiner*—Lincoln Donovan

*Attorney, Agent, or Firm*—Carl A. Forest

[57] ABSTRACT

A magnetic relay is packaged for automated assembly. The armature of the relay is held by an L-shaped frame that is easily assembled and is firmly held in position to insure electrical contact alignment. One of the terminals of the five terminals of the relay is inserted into a side of the base for the relay instead of from the top of the base. This provides a better control of the air gap between the relay armature and the contact.

1 Claim, 2 Drawing Sheets

SMALL RELAY FOR AUTOMATED ASSEMBLY

BACKGROUND OF THE INVENTION

The present invention pertains to a relay and more particularly to a relay that is packaged for automated assembly and in addition provides for good electrical contact alignment and air gap control.

Relays have many commercial applications where it is necessary to open and close electrical contacts as needed. In some applications, automotive for example, it is necessary that the relay be of a miniature size. And because of the competition, it must be packaged not only for the small size but for automated assembly. In addition, the relay must be accurate in its performance. The relay of the present invention substantially meets these needs.

SUMMARY OF THE INVENTION

Accordingly, there is provided a relay which comprises a base, a coil bobbin carried by the base; a magnetic core carried in the coil bobbin; an L-shaped frame carried by the base and extending over the coil bobbin; electrical terminals carried by the base; an electrical contact spring blade carried by the base; a first notch in a distal end of the L-shaped frame providing first tabs extending from and along opposite sides of the L-shaped frame; an armature, the armature having a second notch at an end thereof providing second tabs extending from and along opposite sides of the armature; and third notches in the second tabs opening in the same direction; the first, second, and third notches and the first and second tabs constructed and arranged to pivotally mount the armature at the distal end of the L-shaped frame between the electrical contact spring and the coil bobbin.

One of the electrical terminals is mounted through a notch opening in a side of the base.

DETAILED DESCRIPTION OF THE INVENTION

Figure 1:
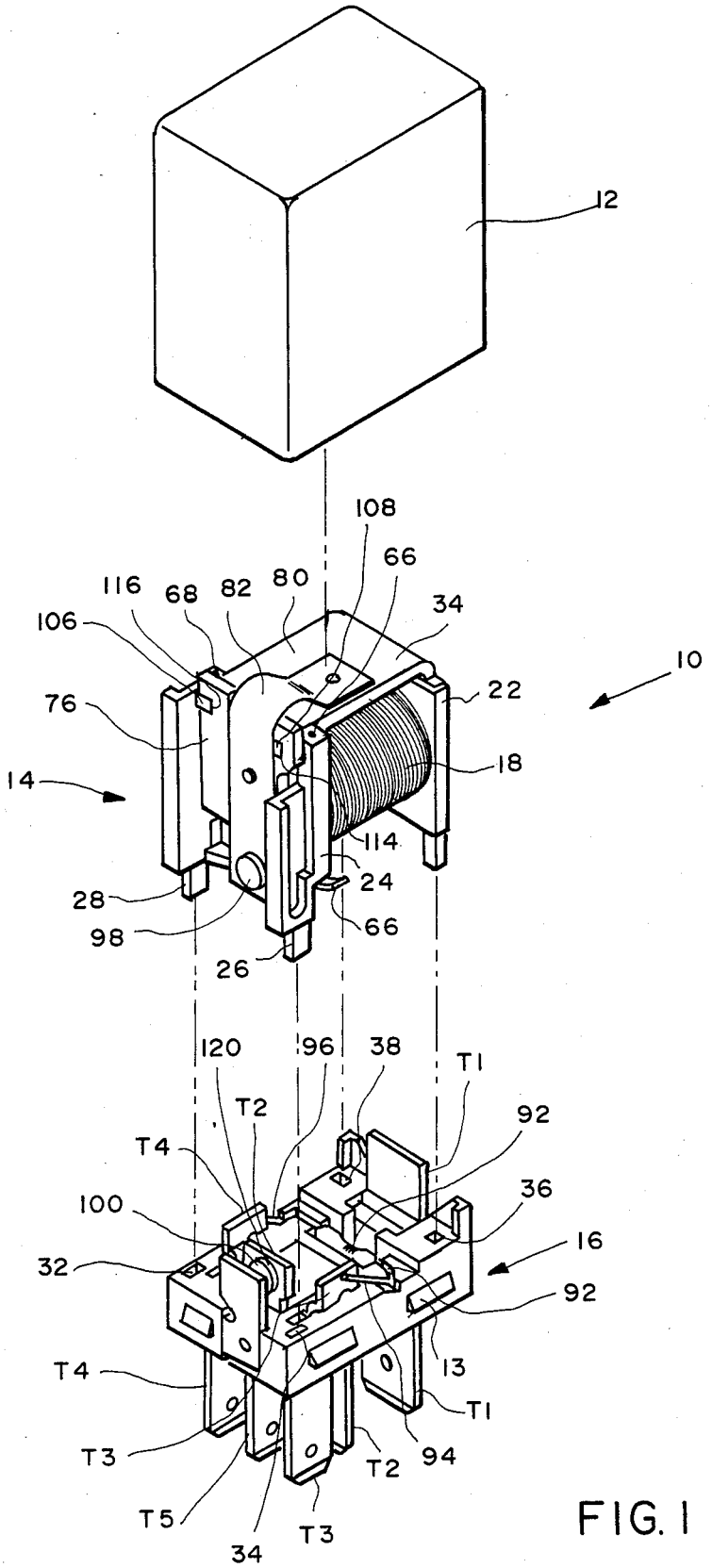
FIG. 1 is an exploded view of the relay showing its principle element.
Figure 2:
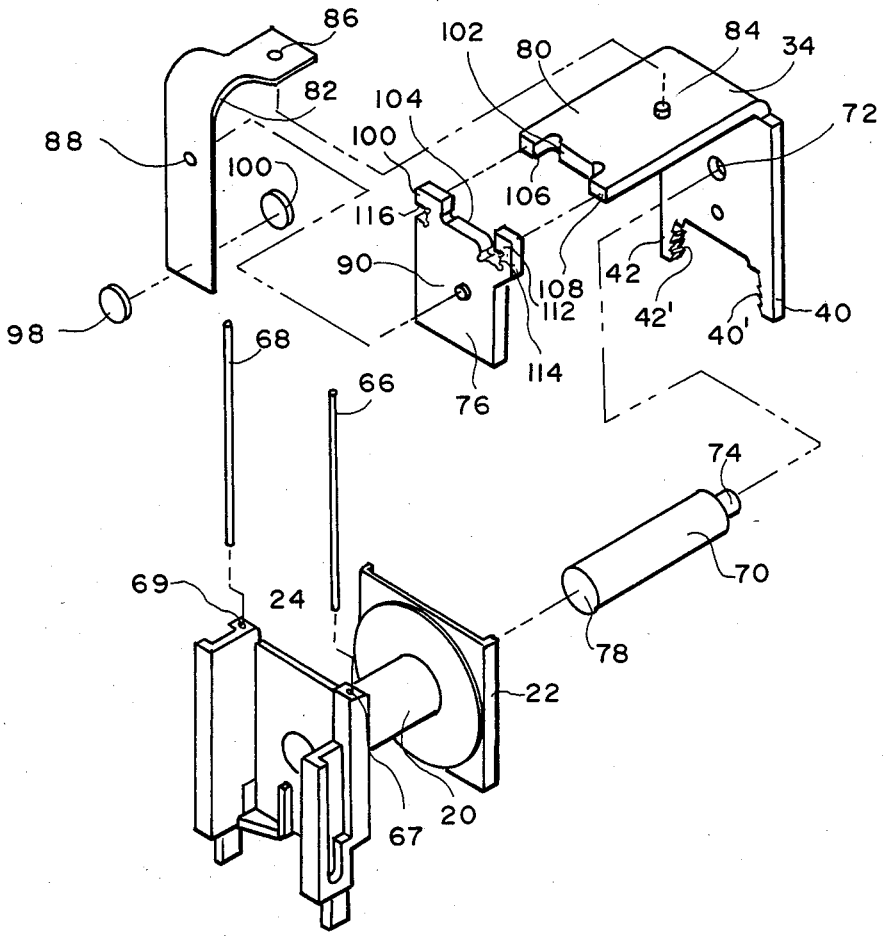
FIG. 2 is an exploded view showing the relay in greater detail.
Figure 2:
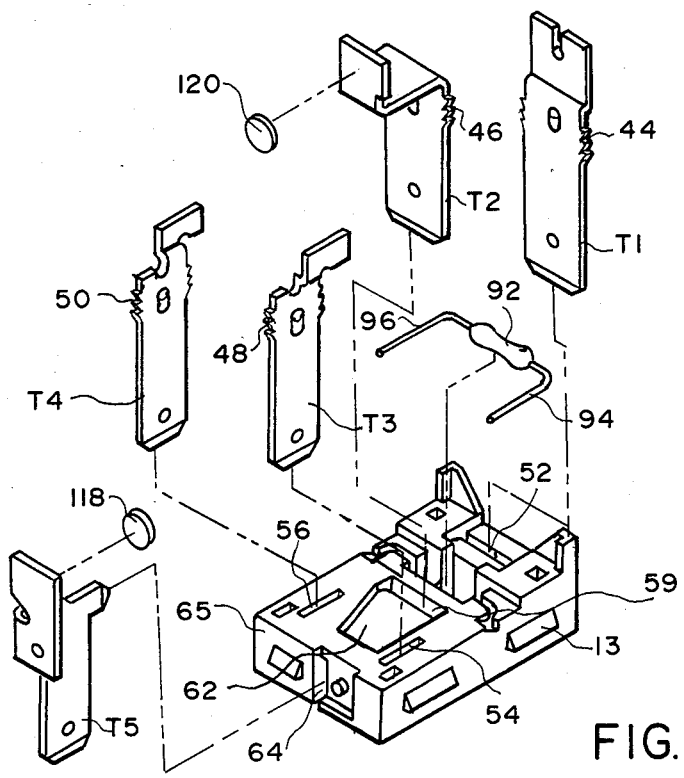

Referring now to the drawings there is shown a relay 10 which in general includes a cover 12, a coil bobbin assembly 14, and a base 16. Cover 12 is held on base 16 by having its walls snap over tabs 13. The coil bobbin includes a magnet wire 18 wound on a spindle 20 which is wedged between frames 22 and 24. Frame 24 is carried by base 16 through legs 26 and 28 which engage slots 34 and 32 in base 16. Frame 22 is wedged between L-shaped frame 34 which is carried in slots 36 and 38 through legs 40 and 42. As shown, legs 40 and 42 have saw-toothed portions 40' and 42' which are force fitted into the slots.

Electrical terminals $T_1$, $T_3$, and $T_4$ are carried in base 16 by force fitting their saw-toothed edges 44, 46, 48 and 50 into their respective slots 52, 59, 54 and 56. Electrical terminal $T_5$ is held in base 16 through a slot 64 in sidewall 65 of base 16. All of the electrical terminals are fabricated of good electrically conductive material such as copper or brass while base 16 and frames 22 and 24 are fabricated of a suitable plastic.

Electrical terminals $T_3$ and $T_4$ serve as terminals for supplying electrical power to magnetic wire 18. One end of wire 18 is attached to wire bobbin terminal 66 with the other being attached to wire bobbin terminal 68. Wire bobbin 66 is then electrically connected to terminal $T_3$ through some suitable method such as by soldering. In like manner, terminal $T_4$ is connected to wire bobbin 68. As shown, wire bobbin terminals 66 and 68 are carried in holes 67 and 69 provided in frame 24.

A core 70 is carried within spindle 20 of coil bobbin assembly 14 for directing the flux generated by winding 18. The core is anchored in aperture 72 of L-shaped frame 34 through lug 74. An air gap (not shown) is left between armature 76 and the end 78 of the core.

A suppression means, for example resistor 92, is carried in base 16. It is electrically coupled to electrical terminals $T_3$ and $T_4$ through rods 94 and 96 that are soldered or welded to their respective terminals.

A portion 80 of L-shaped member 34 extends over coil bobbin assembly 14. A spring contact blade 82 is connected to the L-shaped member by staking or welding to extrusion 84 in the L-shaped member and aperture 86 in the blade and to armature 76 through apertures 88 and extrusion 90. The contact blade carries electrical contacts 98 and 100.

Armature 76 is pivotally mounted on L-shaped member 34 in such a manner that the armature is restrained from misalignment while still providing clearance for spring contact blade 82. As shown, L-shaped member 34 has a notch 102 which receives armature 76 through its notch 104. Notch 102 leaves tabs 106 and 108 along the sides of the portion 80 which extends over coil assembly 14. Notch 104 leaves tabs 110 and 112 along the sides of armature 76. Tabs 110 and 112 have notches 114 and 116 which open in the same direction. As best shown in FIG. 1, tabs 106 and 108 are held in notches 114 and 116, the notches being of sufficient size to permit the armature to slightly pivot.

When fully assembly, electrical contact 98 carried by spring blade 82 will mate with electrical contact 118 carried by electrical terminal $T_5$ and electrical contact 100 carried by the spring blade will mate electrical contact 120 carried by terminal $T_2$. With this arrangement, it is essential that not only should the air gap between core 70 and armature 76 be maintained, it is also necessary that the predetermined air gaps between electrical contacts be maintained. This has been aided by, as previously noted, mounting electrical terminal $T_5$ in slot 64 of side 65 of base 16.

The operation of the relay is generally the same as relays known in the art. When power is applied to terminals $T_3$ and $T_4$, a flux is generated in coil 18. The flux is directed by core 70 through L-shaped frame 34 to armature 76 where a magnetic force is generated in the air gap between core 70 and the armature. When the force is high enough, armature 76 pivots to close against the core. This closes electrical contacts 100 and 120; contacts 98 and 118 being normally closed they are now opened.

What is claimed is:

1. A relay comprising:

a base, a coil bobbin carried by said base, a magnetic core carried in said coil bobbin, an L-shaped frame carried by said base and extending over said bobbin, at least two electrical terminals carried by said base, each having a contact thereon, an electrical spring contact blade having at least two electrical contacts, said blade carried by said base between said two electrical terminals and said electrical contacts carried by said blade adapted to mate with contacts on said terminals, and wherein one of said electrical terminals is carried by said base in a slot in a wall thereof so as to aid in maintaining predetermined air gaps between said electrical contacts, a first notch in a distal end of said L-shaped frame providing first tabs extending from and along opposite sides of said L-shaped frame, and an armature, said armature having a second notch at an end thereof providing second tabs extending from and along opposite sides of said armature, and third notched in said tabs opening in the same direction, said first, second, and third notches and said first and second tabs constructed and arranged to pivotally mount said armature at said distal end of said L-shaped frame between said electrical spring contact blade and said coil bobbin.

* * * * *